US006918475B2

(12) United States Patent
Lin et al.

(10) Patent No.: US 6,918,475 B2
(45) Date of Patent: Jul. 19, 2005

(54) HANDLE OF TRUNK

(75) Inventors: Jer Hong Lin, Taipei (TW); Boon Hwa Lau, Hsin Chuang (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 10/227,391

(22) Filed: Aug. 26, 2002

(65) Prior Publication Data

US 2003/0042094 A1 Mar. 6, 2003

(30) Foreign Application Priority Data

Aug. 28, 2001 (TW) ..... 90214841 U

(51) Int. Cl.[7] ..... A45C 13/00
(52) U.S. Cl. ..... 190/115; 16/113.1
(58) Field of Search ..... 190/115, 184; 16/113.1

(56) References Cited

U.S. PATENT DOCUMENTS

| | | | | | |
|---|---|---|---|---|---|
| 3,289,799 | A | * | 12/1966 | Bush | 190/115 |
| 5,515,576 | A | * | 5/1996 | Tsai | 16/113.1 |
| 5,816,375 | A | * | 10/1998 | Tu | 190/115 |
| 6,079,527 | A | * | 6/2000 | Kuo | 190/115 |
| 6,470,529 | B1 | * | 10/2002 | Chang | 190/115 X |
| 2001/0035320 | A1 | * | 11/2001 | Tiramani et al. | 190/115 |

* cited by examiner

*Primary Examiner*—Tri M. Mai
(74) *Attorney, Agent, or Firm*—Troxell Law Office, PLLC

(57) ABSTRACT

A handle grip of a trunk having an upper cover unit and a seat unit receiving in the upper cover unit. The seam of the seat unit and the upper cover unit are placed on a top of the handle grip and the stomach portion of the seat unit has no seam. Therefore, when it is held, the hand of the user will not be in contact with the seam of the seat unit and the upper cover unit so as to have a preferred handling feeling.

4 Claims, 5 Drawing Sheets

HANDLE OF TRUNK

BACKGROUND OF THE INVENTION

1. Field of the Invention

The present invention relates to a handle grip of a trunk, and particularly to a handle grip of a trunk with a button, wherein the stomach portion of the seat unit has no seam and when it is held, the seam of the seat unit and the upper cover unit is at a top of the handle grip. Therefore, the manufacturing process and mold cost can be reduced greatly.

2. Description of Related Art

The conventional handle grip of a trunk with button has seams at the stomach portion of the handle grip, as shown in FIG. 5. The handle grip is formed by a seat unit 1, an upper cover unit 2, and a button 3. The volume of the seat unit is approximately equal to that of the upper cover unit 2. After assembled, the seat unit 1 and the upper cover unit 2 are combined at the stomach portion 14 of the handle grip.

In above prior art, as the handle grip is held by the hand, the hand will touch the seam 4. Therefore, the seat unit 1 and the upper cover unit 2 must have preferred precision. Otherwise, an error occurs as the seam 4 is assembled so as to be formed with tip edges and deteriorate the holding sense. To have preferred precision of the seat unit 1 and the upper cover unit 2, the cost of the mold must be increased greatly, and it is difficult to be manufactured.

Moreover, In above prior art, even it has a preferred precision, since the volume of the seat unit 1 is approximately equal to that of the upper cover unit 2, and therefore, a twisting force generates as the handle grip is held by hand. Thus, an error still generates in the seam of the seat unit 1 and the upper cover unit 2. Therefore, the structure is weakened.

SUMMARY OF THE INVENTION

Accordingly, the primary object of the present invention is to provide a handle grip of a trunk, wherein the seam of the seat unit and the upper cover unit can be placed on the top of the handle grip and the stomach portion of the seat unit has no seam. Thereby, when it is held, the hand of the user will not be in contact with the seam of the seat unit and the upper cover unit so as to have a preferred handling feeling.

Another object of the present invention is to provide a handle grip of a trunk, wherein the seat unit is larger and the stomach portion are integrally extended to the frame-like surface. Thereby, it has a preferred structural strength and a preferred tolerable twisting force and thus is tolerable and is not easily deformed.

Another object of the present invention is to provide a handle grip of a trunk, wherein each inner wall of the receiving chamber of the seat unit can be installed with a stepped portion. Thereby, when the upper cover unit is placed into the receiving chamber, each lateral side can be supported by the stepped portion. Thereby, after assembling the upper cover unit, it has a stronger strength. Therefore, the corresponding position between the outer edge of the upper cover unit and the frame-like surface of the seat unit can be assured. Therefore, it is tolerable and not deformed.

A further object of the present invention is to provide a handle grip of a trunk, wherein the upper cover unit of the present invention is further installed with retaining posts for engaging with the seat unit so as to enhance the structural strength of the upper cover unit and prevent that the cover surface from curling in manufacturing and assembling process. Thus, this feature also included in the coverage of the present invention.

To achieve above objects, the present invention provides a handle grip of a trunk comprising an upper cover unit with a button hole; a seat unit receiving in the upper cover unit; and a button unit operative in the button hole. Thereby, the seam of the seat unit and the upper cover unit are placed on a top of the handle grip and the stomach portion of the seat unit has no seam. Thereby, when it is held, the hand of the user will not be in contact with the seam of the seat unit and the upper cover unit so as to have a preferred handling feeling.

The various objects and advantages of the present invention will be more readily understood from the following detailed description when read in conjunction with the appended drawing.

DETAILED DESCRIPTION OF THE PREFERRED EMBODIMENTS

Figure 1:
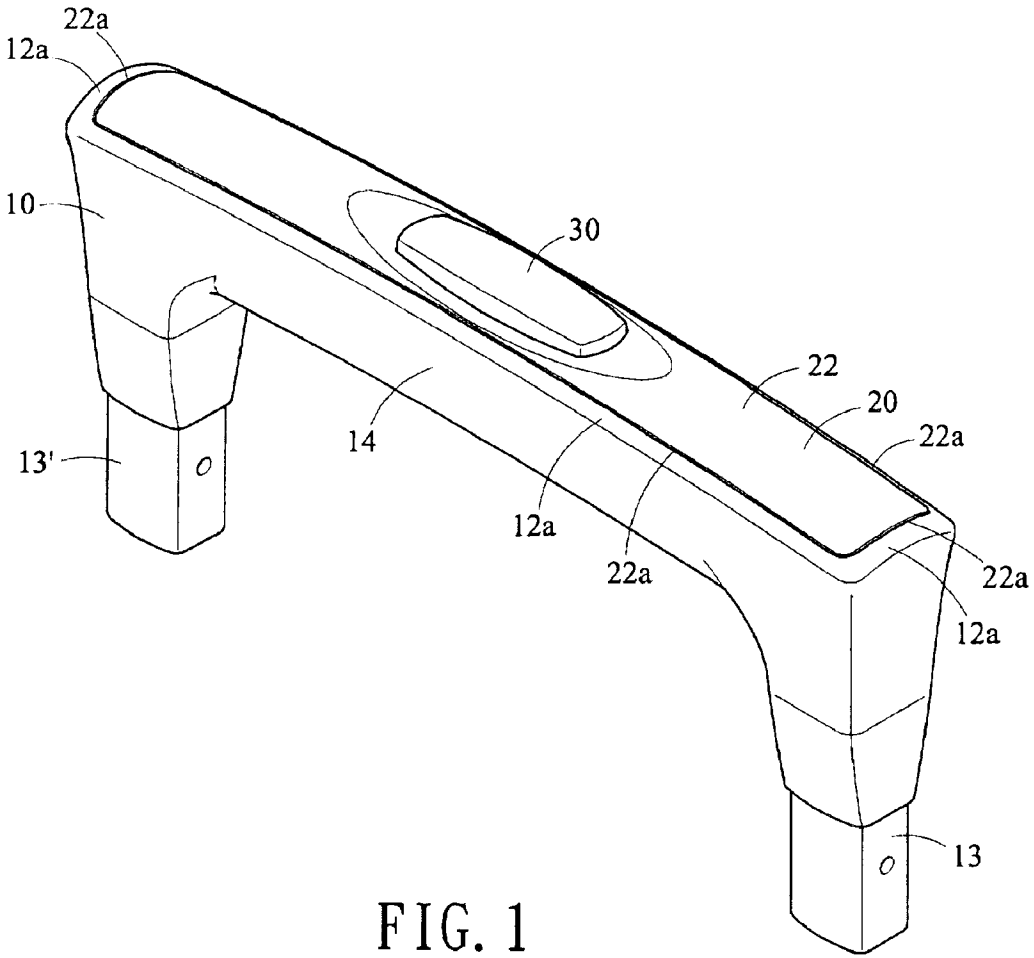
FIG. 1 is a schematic perspective view of a preferred embodiment of the present invention.
Figure 2:
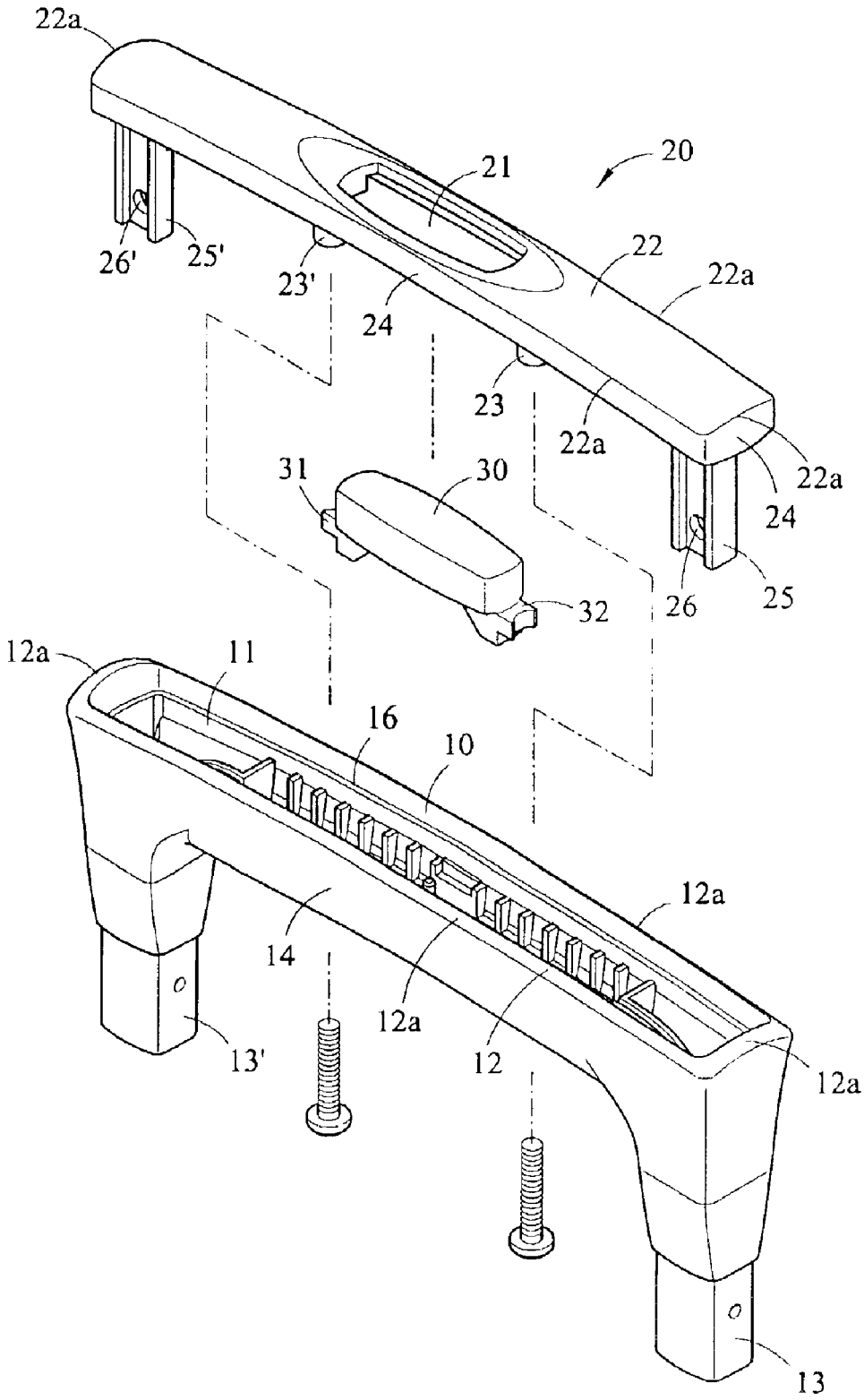
FIG. 2 is an exploded perspective view of the preferred embodiment of the present invention.
Figure 3:
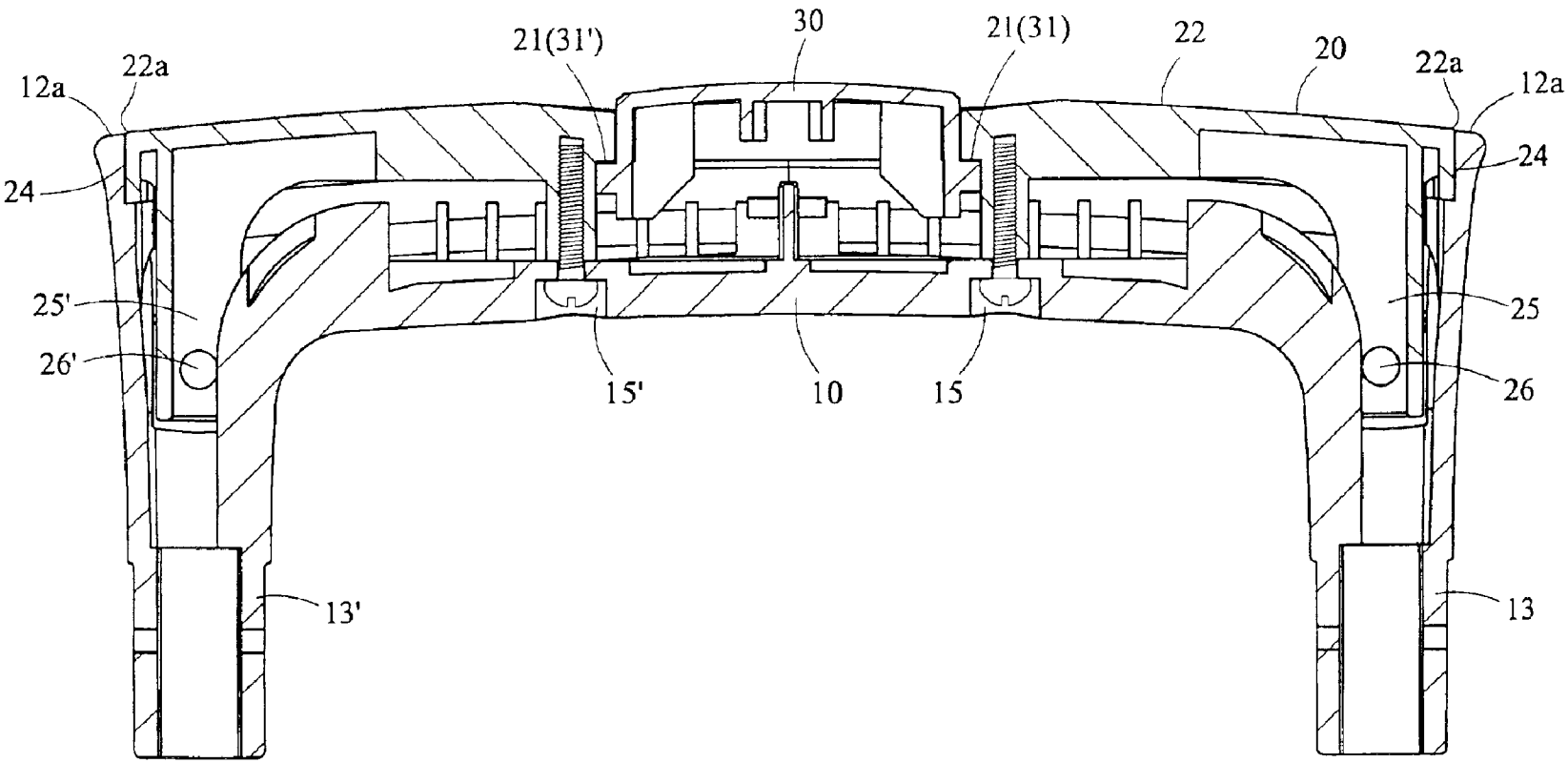
FIG. 3 is a cross sectional view of the preferred embodiment of the present invention.

Referring to FIGS. 1 to 3, a preferred embodiment of the present invention is illustrated. The present invention includes a seat unit 10, an upper cover unit 20, and a button unit 30.

The seat unit 10 is a handle grip seat with a receiving chamber 11. An opening of the receiving chamber 11 is slightly smaller than a top surface 12 so as to be formed with a frame-like surface 12*a*. Two sides at the bottom of the seat are installed with a pair of retaining seats 13, 13' for fastening the pull rod (not shown) of a trunk.

The upper cover unit 20 is a handle grip protecting cover with a button hole 21. After the button unit 30 passing therethrough, then it is placed into the receiving chamber 11. An outer edge 22*a* of the cover surface 22 is exactly engaged with the opening of the receiving chamber 11. The outer edge 22*a* of the cover surface 22 is slightly higher than the frame-like surface 12*a* of the seat unit 10.

Figure 4:
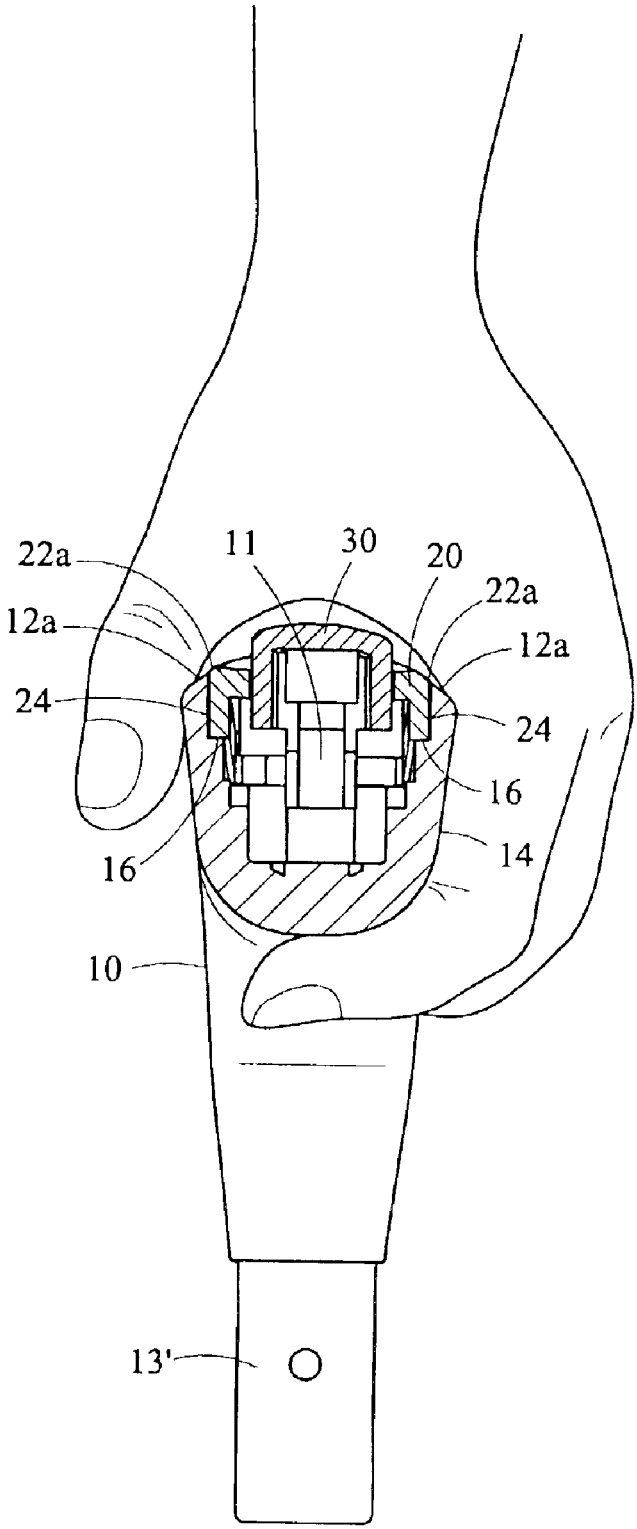
FIG. 4 is a schematic cross sectional view showing the present invention being held by a hand.
Figure 5:
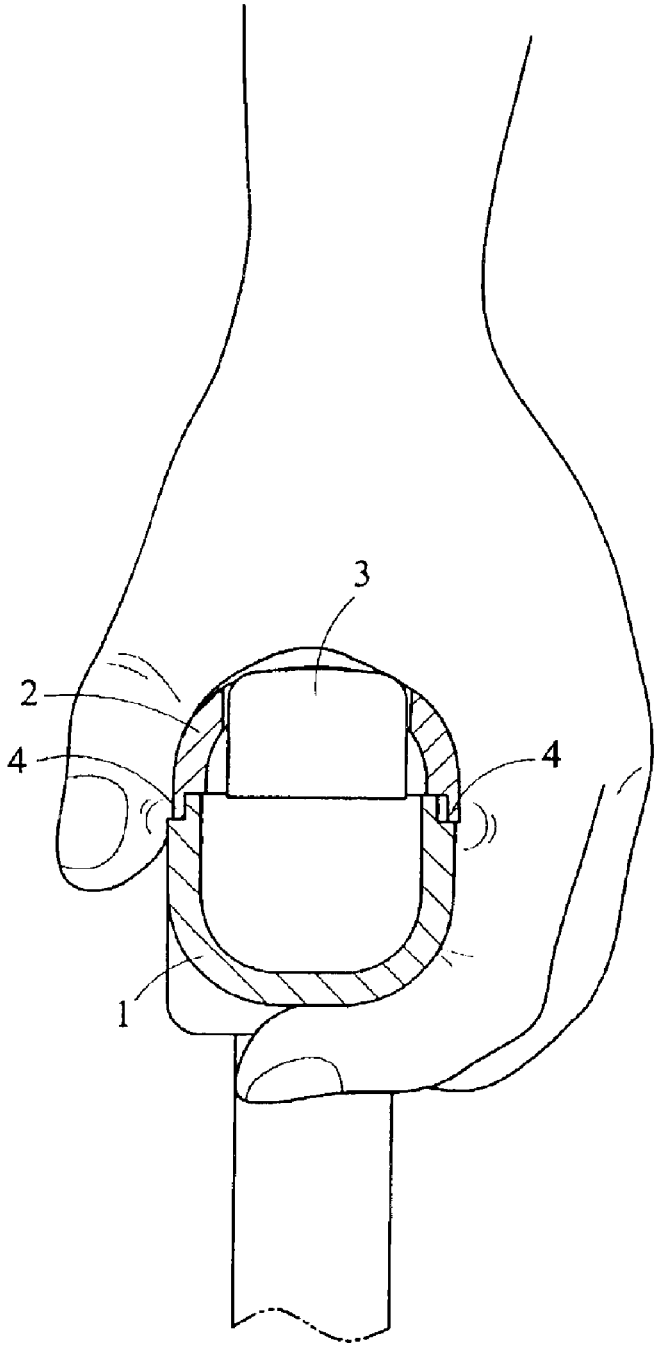
FIG. 5 (PRIOR ART)
FIG. 5 is a schematic cross sectional view showing a handle grip of a prior art held by a hand.

Therefore, as shown in FIG. 3, the seam of the seat unit 10 and the upper cover unit 20 can be placed on the top of the handle grip and the stomach portion 14 of the seat unit 10 has no seam. Thereby, when it is held, as shown in FIG. 4 the hand of the user will not be in contact with the seam of the seat unit 10 and the upper cover unit 20 so as to have a preferred handling feeling.

It should be noted that the upper cover unit 20 of the present invention can be further installed with posts 23, 23' for locking studs. The seat unit 10 (see FIG. 3) can be further installed with embedding holes 15, 15' for being embedded by studs. The seat unit 10 and upper cover unit 20 can be fixed by studs. Besides, the button unit 30 is further installed with ears 31, 32 for confining the button unit 30 in the button hole 21 of the upper cover unit 20. These are preferred embodiments of the present invention.

It should be noted that the structure and configuration of the seat unit 10 and the upper cover unit 20 will cause that the seat unit 10 occupies a larger volume than those of prior arts. Furthermore, no seam exists in the stomach portion 14 of the seat unit 10. Thereby, the handle grip has preferred structural strength and tolerable twisting force, moreover, it is tolerable and not easily deformed.

It should be noted that each inner wall of the receiving chamber 11 of the seat unit 10 can be installed with a stepped portion 16. Thereby, when the upper cover unit 20 is placed into the receiving chamber 11, as shown in FIGS. 3 and 4 each lateral side 24 can be supported by the stepped portion 16. Therefore, after assembling the upper cover unit 20, it has a stronger strength. Therefore, the corresponding position between the outer edge 22*a* of the upper cover unit 20 and the frame-like surface 12*a* of the seat unit 10 can be assured. Therefore, it is tolerable and not deformed.

It should be noted that a bottom of the upper cover unit 20 of the present invention can be further installed with retaining posts 25, 25'. The retaining posts 25, 25' have positioning holes 26, 26', respectively. When the upper cover unit 20 is placed in the receiving chamber 11, the retaining posts 25, 25' and the seat unit 10 can be engaged by a pair of retaining pins. Thereby, after the retaining posts 25, 25' and the seat unit 10 are engaged, the corresponding position between the outer edge 22*a* of the upper cover unit 20 and the frame-like surface 12*a* of the seat unit 10 can be assured. Therefore, it is tolerable and not deformed.

Referring to FIG. 4, a schematic cross sectional view showing the handling of the present invention is illustrated. As shown in the figure, no seam exists in the stomach portion 14 of the seat unit 10, and the seam of the seat unit 10 and the upper cover unit 20 is at a top end of the handle grip. Therefore, when it is held, the hand of the user will not be in contact with the seam of the seat unit 10 and the upper cover unit 20 so as to have a preferred handling feeling. Thereby, the seat unit 10 is larger and the stomach portion 14 are integrally extended to the frame-like surface 12*a*. Thereby, it has a preferred structural strength and a preferred tolerable twisting force and thus is tolerable and is not easily deformed.

It should be noted that even if the injecting mold has a little error in precision so that the outer edge 22*a* of the cover surface 22 and the opening of the receiving chamber 11 are not completely matched, since the engaging portion of the seat unit 10 and upper cover unit 20 of the present invention are at the top of the handle grip and are difficult to be touched as the trunk is held. Thereby, the user may handle it comfortably. Furthermore, the cost and manufacturing process can be simplified greatly.

It should be noted that the seat unit 10 of the present invention has a stepped portion. The function of the stepped portion as shown in FIG. 3 is used to support the lateral sides 24 of the upper cover unit 20 so as to assure that the outer edge 22*a* of the upper cover unit 20 are corresponding to the frame-like surface 12*a* of the seat unit 10 so that the upper cover unit 20 will not be deformed. Furthermore, the strength thereof is increased. Thus, this feature also included in the coverage of the present invention.

It should be noted that the upper cover unit 20 of the present invention is further installed with retaining posts 25, 25' for engaging with the seat unit 10 so as to enhance the structural strength of the upper cover unit 20 and prevent that the cover surface 22 from curling in manufacturing and assembling process. Thus, this feature also included in the coverage of the present invention.

It should be noted that the spirit and scope of the present invention is that the seam of the seat unit 10 and the upper cover unit 20 is at the top of the handle grip. Thereby, the stomach portion 14 of the seat unit 10 has no seam and when it is held, seams for assembling are difficult to be touched. Besides, a large error is allowable in the injecting mold of the seat unit 10 and the upper cover unit 20. Thereby, the manufacturing process and mold cost can be reduced greatly. Therefore, the prior art with seam at the stomach portion is improved. However, this is the main concern of the present invention.

It is to be understood that if the locking device of the pull rods of the handle luggage of the present invention is used by a detent rather than a locking pin, then the above mentioned button unit 30 can be omitted. Therefore, according to the present invention, the button unit 30 is not an essential member.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handle grip of a trunk comprising:

a) a seat unit having:

i) a receiving chamber with an opening on a top of the seat unit;

ii) a frame top surface surrounding the opening of the receiving chamber; and iii) a pair of retaining seats extending downwardly from opposing ends of the seat unit for connecting the seat unit to the trunk;

b) an upper cover unit inserted into the receiving chamber and connected to the seat unit, and having:

i) an outer edge periphery protruding out of the receiving chamber; and ii) a cover surface having an outer edge located on a top of the outer periphery of the upper cover unit and surrounding the cover surface, the cover surface and the outer edge periphery are located above and within an outer periphery edge of the frame top surface of the seat unit;

iii) a button hole; and c) a button unit located between the seat and the upper cover unit, protruding through the button hole, and a top of the button hole extending above the cover surface of the upper cover.

2. The handle grip according to claim 1, further comprising a pair of posts for locking studs extending downwardly from a bottom of the upper cover unit, and a pair of embedding holes protruding through the bottom of the seat unit and aligning with each of the pair of posts for locking studs of the upper cover unit, such that the upper cover unit and the seat unit are connected together by a locking stud inserted through each of the pair of embedding holes and connected to one of the pair of posts for locking studs.

3. The handle grip according to claim 1, further comprising a stepped portion located on a periphery of the receiving chamber, wherein a bottom of the outer periphery of the upper cover unit is supported by the stepped portion.

4. The handle grip according to claim 1, further comprising a pair of retaining posts with positioning holes extending downwardly from opposite ends of a bottom of the upper cover unit for connecting the upper cover unit with the seat unit.

* * * * *